US010939763B2

(12) United States Patent
Bachstein

(10) Patent No.: US 10,939,763 B2
(45) Date of Patent: Mar. 9, 2021

(54) ITEM OF FURNITURE FOR RECLINING

(71) Applicant: Roland Edmund Bachstein, Hohenems (AT)

(72) Inventor: Roland Edmund Bachstein, Hohenems (AT)

( * ) Notice: Subject to any disclaimer, the term of this patent is extended or adjusted under 35 U.S.C. 154(b) by 27 days.

(21) Appl. No.: 16/341,668

(22) PCT Filed: Sep. 29, 2017

(86) PCT No.: PCT/AT2017/000069
§ 371 (c)(1),
(2) Date: Apr. 12, 2019

(87) PCT Pub. No.: WO2018/076031
PCT Pub. Date: May 3, 2018

(65) Prior Publication Data
US 2019/0374032 A1 Dec. 12, 2019

(30) Foreign Application Priority Data
Oct. 24, 2016 (AT) ..... A 492/2016

(51) Int. Cl.
*A47C 13/00* (2006.01)
*A47C 1/14* (2006.01)
(Continued)

(52) U.S. Cl.
CPC ..... *A47C 1/143* (2013.01); *A47C 3/021* (2013.01); *A61H 1/005* (2013.01)

(58) Field of Classification Search
CPC ..... A47C 3/021; A47C 3/02; A47C 1/143; A47C 3/023; A61H 1/005; A61H 1/001; A61H 1/003; A47D 13/107; A47D 13/102
(Continued)

(56) References Cited

U.S. PATENT DOCUMENTS 4,081,869 A * 4/1978 Ash ..... A47D 13/107 5/105
4,141,095 A * 2/1979 Adachi ..... A47D 9/02 297/260.2

(Continued)

FOREIGN PATENT DOCUMENTS

CH 704322 7/2012
DE 3419008 12/1985

(Continued)

OTHER PUBLICATIONS

Aalto-Liege, No. 39_03, http://miniaturstuhl.de/wp-content/uploads/2013/05/Aalto-Liege-Nr, 1 pg., Jan. 1, 2016, (admitted prior art).

(Continued)

*Primary Examiner* — Chi Q Nguyen
(74) *Attorney, Agent, or Firm* — Volpe Koenig

(57) ABSTRACT

A recliner (1), including a reclining surface (2) and a substructure (3) that can be set on a base and supports the reclining surface (2), the substructure (3) including at least one stand (4) and at least one spring element (5) that is positioned between the stand (4) and the reclining surface (2), the reclining surface (2) being mounted on the spring element (5), the spring element (5) elastically pretensioning the reclining surface (2) in the direction (6) leading away from the stand (4), and the reclining surface (2), when unloaded, being held in an elastically pretensioned manner by a limiting element (7) of the recliner (1).

12 Claims, 4 Drawing Sheets

(51) Int. Cl.
*A47C 3/021* (2006.01)
*A61H 1/00* (2006.01)

(58) Field of Classification Search
USPC ... 297/118, 133, 446.2, 32, 33, 55, 16.1, 20, 297/258.1, 260.3, 270.1
See application file for complete search history.

(56) References Cited

U.S. PATENT DOCUMENTS

| | | | | |
|---|---|---|---|---|
| 4,188,678 | A * | 2/1980 | Rawolle | A47D 13/107 5/105 |
| 4,790,596 | A * | 12/1988 | Shifferaw | A47C 3/021 248/628 |
| 4,850,645 | A * | 7/1989 | Crockett | A61G 5/14 297/330 |
| 5,503,458 | A * | 4/1996 | Petrie | A47D 13/107 297/452.13 |
| 5,615,428 | A | 4/1997 | Li | |
| 6,341,816 | B1 * | 1/2002 | Chen | A47D 1/02 297/16.1 |
| 6,361,106 | B1 * | 3/2002 | Huang | A47D 13/107 297/16.1 |
| 6,574,806 | B1 | 6/2003 | Maher | |
| 7,021,711 | B1 * | 4/2006 | Hoffman | A47C 1/0355 297/270.1 |
| 2003/0020317 | A1 * | 1/2003 | Keegan | A47D 13/107 297/446.2 |
| 2008/0203772 | A1 * | 8/2008 | Holdampf | B60N 2/3065 297/15 |
| 2008/0217975 | A1 * | 9/2008 | Casteel | A47C 1/0352 297/261.1 |
| 2011/0260507 | A1 | 10/2011 | Parness et al. | |
| 2012/0180212 | A1 * | 7/2012 | Gooris | A47D 13/107 5/101 |

FOREIGN PATENT DOCUMENTS

| | | |
|---|---|---|
| DE | 20020607 | 4/2001 |
| DE | 102008032232 | 1/2010 |
| DE | 102011012378 | 8/2012 |
| DE | 102013105158 | 11/2014 |
| DE | 202015005849 | 12/2015 |
| EP | 1645257 | 4/2006 |
| FR | 1300265 | 6/1962 |
| WO | 2014134467 | 9/2014 |

OTHER PUBLICATIONS

Reproduction of a “Relax-Schaukel” and a “Schaukel mit Gestell”, 1 pg., Jan. 1, 2016, (admitted prior art).
www.heilpraxisnet.de, 6 pages, Jun. 20, 2011, (admitted prior art).

* cited by examiner

ITEM OF FURNITURE FOR RECLINING

BACKGROUND

The present invention relates to a recliner, comprising a reclining surface and a substructure that can be set on a base and supports the reclining surface, the substructure having at least one stand and at least one spring element arranged between the stand and the reclining surface, and the reclining surface being mounted on the spring element.

Recliners of this kind are known in principle. An example of these recliners is disclosed in DE 10 2013 105 158 A1. The latter document proposes unbalance rotation motors for setting the reclining surface of the recliner in oscillation.

The prior art has also disclosed recliners in which the spring element has spring legs bent in a C shape. Such recliners are also designated as cantilever chairs.

Physiological studies have shown that, even in adults, a swinging movement makes it easier to fall asleep and allows better sleep. According to these studies, regular movements promote a healthy deep sleep. The spring elements of cantilever chairs known in the prior art have to be made so hard that they lead to a relatively high-frequency oscillation.

SUMMARY

The object of the invention is to improve a recliner of the abovementioned type such that it better promotes the sleep and/or rest of the person lying on the reclining surface.

To achieve this object, the invention proposes that, in a recliner of the abovementioned type, the spring element elastically pretensions the reclining surface in a direction away from the stand, and the reclining surface, in the unloaded state, is kept elastically pretensioned by a limiting element of the recliner.

In other words, provision is made according to the invention that the spring element supporting the reclining surface is maintained in an elastically pretensioned state, even in the unloaded state, by an additionally present limiting element. This permits oscillation of the reclining surface at a lower frequency than in the prior art when a person lies down on the reclining surface. This makes it easier for the person lying on the reclining surface to fall asleep and also to sleep through, or it can at least have a relaxing effect on the person.

The fact that a recliner according to the invention has corresponding elastic pretensioning would be seen immediately if the limiting element is removed, since the reclining surface would then be deflected farther in the direction away from the stand due to the elastic pretensioning.

The recliner can have one or more stands. Said stand or stands are the structural parts of the recliner which, in the normal operational position, bear directly on the ground surface on which the recliner is placed. In the case of several stands, they are preferably arranged in one plane.

The substructure can in principle have very different configurations in recliners according to the invention. At any rate, the substructure supports the reclining surface and for this purpose has the at least one stand and at least one elastic spring element arranged between the stand and the reclining surface. The limiting element is also preferably a component of the substructure provided in addition to the spring element. For example, the limiting element can be configured as a strap or loop. The unloaded state is the state in which the substructure exclusively supports the inherent weight of the recliner. Therefore, in the unloaded state, there is neither a person nor any other load lying on the reclining surface.

The reclining surface is the structural part of the recliner on which the person lies down. Therefore, it is not a surface in the mathematical sense, but a body which is provided and shaped for the purpose that the person using the recliner lies down on the reclining surface. However, the bearing surface, i.e. the face of the reclining surface on which the person then ultimately lies, can also have a curved design. Provision is preferably made that the bearing surface of the reclining surface has a depression for the buttocks and also an elevation as a backrest and an elevation as a knee support. For example, the reclining surface and the bearing surface can have an approximately S-shaped curve or the like.

The limiting element limits the deflection of the reclining surface in the unloaded state, preferably in the direction away from the stand. In addition to the limiting element, the recliner can also have a stop element for limiting a deflection of the reclining surface, in the loaded state, in a direction toward the stand. The loaded state is a state in which an additional mass, e.g. a person using the recliner, lies on the reclining surface. With such a stop element, it is possible, for example, to avoid overloading or breaking the spring element when there is too great a load on the reclining surface, e.g. due to too great an additional mass. The elastic pretensioning, according to the invention, of the spring element can have the effect that, on the one hand, the spring element in the loaded state is still suitable for supporting correspondingly high additional masses, and correspondingly heavy persons, and, on the other hand, is able to oscillate with a relatively low frequency in this state. The low-frequency oscillation thus achieved means that the recliner has a soothing action and promotes sleep. In recliners according to the invention, provision is particularly preferably made that the reclining surface, in the unloaded state, is arranged in a starting position, and, in a state when loaded with an additional mass, preferably of 85 kg, lying on the reclining surface, is arranged in an intermediate position deflected relative to the starting position. The spring element is thus preferably configured such that the intermediate position is obtained after the additional mass has been placed onto the reclining surface. Preferably, provision is then made that the reclining surface can swing freely in the loaded state about the deflected intermediate position. The fact that the reclining surface in the loaded state can swing freely about the deflected intermediate position signifies that the reclining surface, in the loaded state, swings out after a single deflection in the form of a free, damped oscillation. The spring element is preferably configured here such that the oscillation from the intermediate position is excited without additional drives and solely by the person lying on the reclining surface. Particularly preferably, provision is made that a person's breathing is on its own sufficient to excite the oscillation of the reclining surface and of the additional mass lying on it in the form of a person. The pretensioning according to the invention, which is maintained in the unloaded state by the limiting element, has the advantage that the intermediate position can be reached from the starting position with a relatively short excursion of the spring element, and the desired oscillation is then possible. Without pretensioning, a very long excursion to the intermediate position would have to be allowed for in order then to be able to execute the desired oscillations. This would result in a structure that is very shaky and difficult to control, which is prevented by the pretensioning according to the invention.

In particularly preferred variants of recliners according to the invention, provision is made that the reclining surface, with an additional mass of 85 kg lying on the reclining surface, and after a single deflection from a rest position in a direction toward the stand, has an oscillation frequency of between 0.1 and 1 Hertz in a free oscillation following the deflection. Since the free oscillation after a single deflection is a so-called natural oscillation of the system composed of recliner and additional mass, the oscillation frequency could also be designated as a natural frequency. In the preferred abovementioned illustrative embodiments, the rest position, starting from which the deflection takes place for excitation of the subsequent free oscillation, could also be designated as the intermediate position. The relationship between inertia of mass and spring stiffness is decisive for the oscillation frequency.

To be able to oscillate the reclining surface, together with the person or additional mass lying thereon, solely through the person's breathing, it is preferable if the spring element has relatively low oscillation damping. In this connection, in preferred variants of recliners according to the invention, provision is made that the reclining surface, with an additional mass of 85 kg lying on the reclining surface, and after a single deflection from a rest position in a direction toward the stand, has an amplitude retention of greater than or equal to 20% in a free oscillation following the deflection, wherein the amplitude retention is calculated from the ratio of an amplitude of the sixth oscillation period after deflection to an amplitude of the second oscillation period after deflection. The term "after deflection" signifies here that the oscillation periods are counted from the start of the free oscillation. Whereas the first oscillation period is generally still heavily influenced by the deflection or the oscillation excitation, the second oscillation period generally already involves a free, damped oscillation. The pretensioning and the other elastic properties of the spring element are preferably chosen in such a way as to ensure that neither the limiting element nor the optionally present stop element disturbs this free oscillation.

Preferred methods by which the abovementioned oscillation frequency and amplitude retention, for example, can be measured are explained in detail in the description of the figures.

In principle, the spring element of the recliner according to the invention can have very different configurations. In preferred embodiments, provision is made that the at least one spring element has two spring legs which are connected to each other in a connection region. In the unloaded state, the spring legs can be arranged running at least in part away from each other starting from the connection region. Particularly preferably, the legs are arranged one above the other in the operational position of the recliner. It is possible, for example, that the one or more stands are arranged on the lower spring leg, while the reclining surface rests on the upper spring leg of the spring element, either directly or with interposition of the adjustment device mentioned below. It is possible, but not essential, for the two spring legs to be integrally connected to each other in the connection region. The connection region can be C-shaped, for example. The connection region is preferably arranged under or next to the half of the reclining surface pointing toward the foot end. The spring legs then preferably extend at least in part away from each other in the direction toward the head end.

The substructure of the recliner according to the invention can have precisely one spring element or several spring elements. In particularly preferred variants of the invention, provision is made that the substructure has precisely two spring elements. These can be arranged at a distance from each other on opposite sides of the reclining surface. Each of these spring elements can be configured according to the abovementioned preferred embodiments.

In particularly preferred variants of recliners according to the invention, provision is made that the recliner has an adjustment device for adjusting the reclining surface relative to the spring element in mutually opposite longitudinal directions of the reclining surface.

This adjustment device allows the intermediate position to be reached, and it also permits adjustment of the oscillation frequency of oscillations of the reclining surface in the loaded state for different additional masses or persons of different weight, i.e. deviating from 85 kg. In this way, the desired oscillation frequency can also be adjusted for persons of different weight, i.e. for additional masses of different sizes lying on the reclining surface. The adjustment device thus affords the possibility of adapting the function of the recliner to the weight of the person lying on the reclining surface. The adjustment of the reclining surface by means of the adjustment device does not necessarily have to take place in exactly horizontal, mutually opposite longitudinal directions of the reclining surface. However, in the operational position, the longitudinal directions in which the adjustment device can adjust the reclining surface relative to the spring element preferably have at least one horizontal component. The adjustment device is preferably configured so as to be lockable. This means that, while the adjustment device permits an adjustment of the reclining surface relative to the spring element, it nevertheless also permits locking of the respective position that has been set. In this connection, provision is particularly preferably made that the adjustment device is of a self-locking or self-inhibiting configuration, that is to say secures the adjusted position by itself, without any additional measure having to be taken for this purpose. The adjustment device is preferably arranged between the substructure and the reclining surface, preferably between the spring element and the reclining surface. It could also be said that the substructure and/or the spring element are/is connected to the reclining surface via the adjustment device. So as not to unnecessarily disturb the oscillation of the reclining surface in the loaded state, the adjustment device is preferably configured free of play. In the locked state, it should guarantee a virtually rigid connection between the reclining surface and the substructure.

The adjustment device can have different configurations. For example, it can be in the form of a kind of carriage. The adjustment device can, for example, have at least one toothed wheel for engagement in at least one toothed rack. However, worm drives, hydraulic or pneumatic piston-cylinder arrangements or other linear drives known per se could also equally well be used. The adjustment device is preferably adjustable by hand. However, adjustment devices driven by a motor, e.g. by an electric motor, are also conceivable.

Besides the recliner itself, the invention also relates to a use of a recliner according to the invention, which use is characterized in that a person lies down on the reclining surface and, in this way, the reclining surface is deflected from a starting position, which the reclining surface adopts in an unloaded state, to an intermediate position deflected relative to the starting position, and the reclining surface with the person lying on it is moved, starting from the intermediate position, in an oscillation excited only by the person's breathing. In the intermediate position, as also in the excited oscillation from the intermediate position, the reclining surface is preferably not influenced by the limiting element or by the optionally present stop element. The oscillation excited by the person's breathing is preferably in the range of between 0.1 Hertz and 1 Hertz, i.e. in the range of the abovementioned natural frequencies or oscillation frequencies of a free oscillation. As a result of the excitation permanently taking place by the person's breathing, a natural frequency range of the system, composed of the recliner and of the person lying thereon, is thus excited, such that the low forces and accelerations occurring during breathing are sufficient to excite the oscillation. It has been found that relatively low oscillation amplitudes are sufficient for achieving the soothing and sleep-promoting action of the recliner according to the invention. In preferred recliners, an adaptation to the respective weight of the person lying on the reclining surface, for achieving the intermediate position, can be effected with the abovementioned adjustment device.

BRIEF DESCRIPTION OF THE DRAWINGS

Further features and details of preferred embodiments of the invention are explained below in the description of the figures with reference to the embodiment variants depicted in FIGS. 1 to 10, in which.

DETAILED DESCRIPTION

Figure 9:
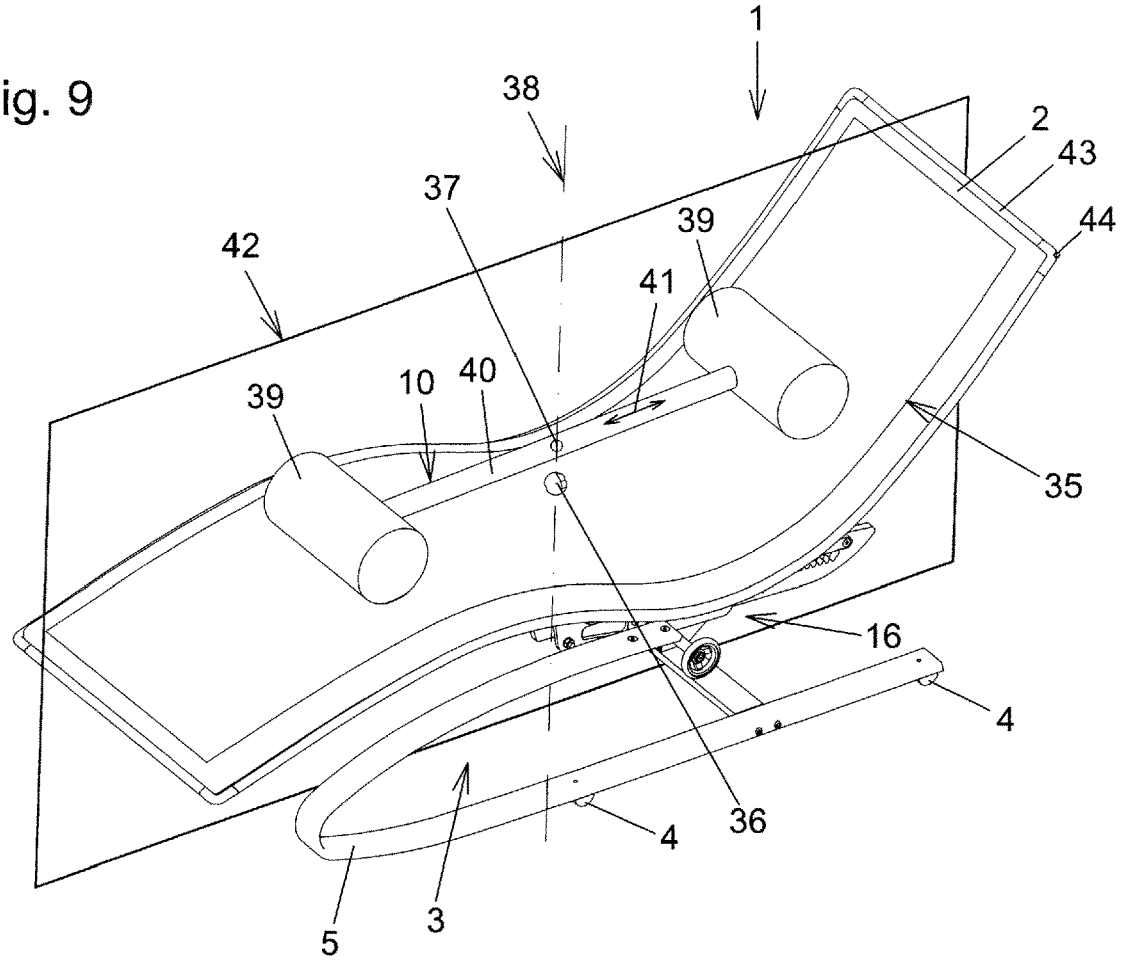
FIGS. 9 and 10 show views explaining methods for determining the oscillation frequency and the amplitude retention in recliners according to the invention.

The first embodiment of a recliner 1 according to the invention shown in FIGS. 1 to 6 and in FIG. 9 has a curved reclining surface 2 which, in the buttocks region, has a depression, in relation to which the backrest region and also the region provided for supporting the knees are raised. Toward the foot end 50, the reclining surface 2 again slopes downward. In the illustrative embodiment shown, the reclining surface 2 is composed of a reclining frame 18 and of cushioning 19. However, the reclining surface 2 may also be configured differently from the illustrative embodiment shown here, both in terms of its shape and also its construction.

Irrespective of its design, the reclining surface 2 is supported on the substructure 3 of the recliner 1. The substructure 3 in turn is supported with its stands 4 on the ground surface. In the illustrative embodiment shown, and in other preferred variants too, the stands 4 are arranged in one plane, such that the recliner 1 can rest fully on a flat base. In all of the embodiment variants shown here, the substructure 3 has two spring elements 5 arranged parallel to each other on mutually opposite sides of the reclining surface 2, as can be seen in particular in FIG. 4. Each of these spring elements 5 has two spring legs 13 and 14, wherein the spring leg 13, in the operational position shown, is in each case arranged above the spring leg 14. In the variants shown here, the stands 4 are arranged at the lower of the spring legs 14. The upper spring leg 13 supports the reclining surface 2. In the preferred variants shown here, the adjustment device 16 is arranged between the substructure 3, or the respective upper spring legs 13, and the reclining surface 2.

The two spring legs 13 and 14 are connected to each other in a connection region 15 of the respective spring element 5. In the first illustrative embodiment according to FIGS. 1 to 6 and 9, this is an integral connection. The connection region 15 is C-shaped in this illustrative embodiment. The connection region 15 is oriented in the direction of the foot end 50 of the reclining surface 2. The spring legs 13 and 14 run at least in part away from each other toward the head end 43 of the reclining surface 2.

The adjustment device 16 has a carriage-like configuration and permits an adjustment of the reclining surface 2 in longitudinal directions 17 relative to the substructure 3 and to the spring elements 5 and the stands 4. This is largely a horizontal adjustment, although, as has been stated above, it can also have vertical components. The design of the adjustment device 16 in the illustrative embodiments shown here is explained in more detail below on the basis of FIGS. 4 to 6.

According to the invention, the spring elements 5 elastically pretension the reclining surface 2 in a direction 6 away from the stand 4 or the stands 4. In the unloaded state shown in FIGS. 1 and 2, the reclining surface 2 is kept elastically pretensioned by a limiting element 7 of the recliner. This elastic pretensioning could be demonstrated by the fact that, if one were to release the limiting element 7, the reclining surface would be deflected by the spring element away from the stands 4 farther than is the case in the starting position according to FIGS. 1 and 2 in the unloaded state. The limiting element 7 is a kind of stop which maintains the spring elements 5 in the pretensioned state even when the reclining surface 2 is unloaded.

In the illustrative embodiment shown, the two lower spring legs 14 of the two spring elements 5 are rigidly connected to each other via a stop bracket 20. One end of the limiting element 7, configured here as a strap or band, is secured to the stop bracket 20. In the illustrative embodiment shown, the opposite end of the limiting element 7 is connected to a component of the adjustment device 16 fixedly connected to the upper spring limbs 13. However, the limiting element 7 could of course also be connected to the spring limbs 13 and 14 in some other way, in order to keep the spring elements 5 elastically pretensioned even in the unloaded state.

It will be noted in principle that the limiting element 7 does not necessarily have to be configured as a strap or loop. It could involve differently designed component parts that keep the spring element 5 or the reclining surface 2 elastically pretensioned in the unloaded state.

In the variants shown here, a stop element 8 is provided in addition to the limiting element 7. The stop element 8 limits the deflection of the reclining surface 2 in the direction 9 toward the stand 4 in the loaded state. Therefore, in the event of an overload, i.e. an excessive load applied to the reclining surface 2, the stop element 8 prevents the spring element 5 from being destroyed or otherwise adversely affected by the overload. In the illustrative embodiments shown, the stop element 8 is likewise secured to the stop bracket 20. Upon corresponding deflection of the spring elements 5, it interacts with a counter-stop 21, which is fixedly connected to the upper of the spring legs 13.

Both the limiting element 7 and the stop element 8 can be damped, e.g. by giving them a certain elasticity.

Figure 1:
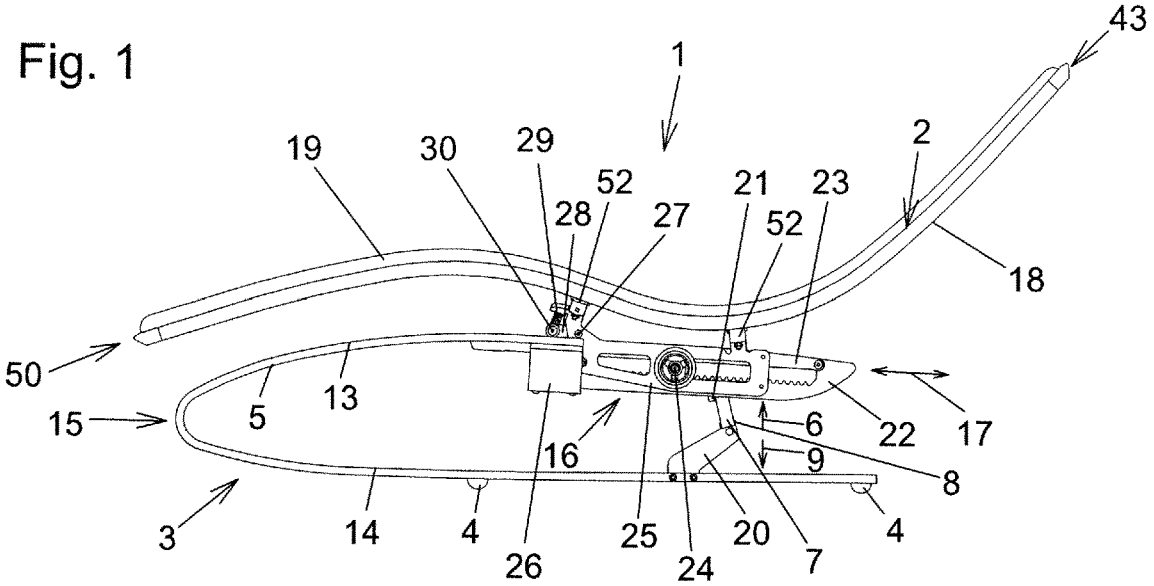
FIG. 1 shows a side view of a first illustrative embodiment of a recliner according to the invention in the unloaded state.
Figure 2:
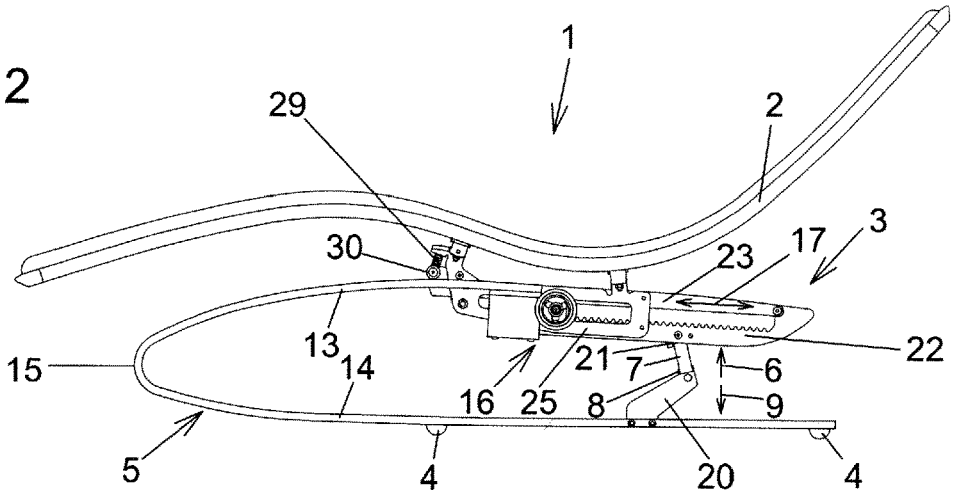
FIG. 2 shows the recliner from FIG. 1, wherein the position of the reclining surface relative to the substructure has been adjusted.

Comparing FIGS. 1 and 2, it will be clearly seen that in FIG. 2, by suitable actuation of the adjustment device 16, the reclining surface 2 has been adjusted in one of the longitudinal directions 17 relative to the substructure 3 or to the stands 14. As was already mentioned at the outset, this longitudinal adjustment by means of the adjustment device 16 allows the oscillation frequency for an oscillation to be set according to the weight of the person lying on the reclining surface 2. In other words, the adjustment device 16 can be used for weight adaptation.

FIGS. 1 and 2 show the starting position of the reclining surface 2 in the unloaded state. If an additional mass 10, e.g. in the form of a person (shown in stylized fashion in FIG. 3), is now placed on the reclining surface 2, a loaded state is reached in which the reclining surface 2 together with the additional mass 10 lying thereon is deflected to an intermediate position. The intermediate position is indicated by solid lines in FIG. 3. The starting position according to FIG. 2 is shown by broken lines in FIG. 3. It will be noted that the person or additional mass 10, shown schematically in FIG. 3, lies on the reclining surface 2 in the position provided for the use of the recliner 1, the person's head being arranged near the head end 43 and the person's feet being arranged near the foot end 50 of the reclining surface 2.

Figure 3:
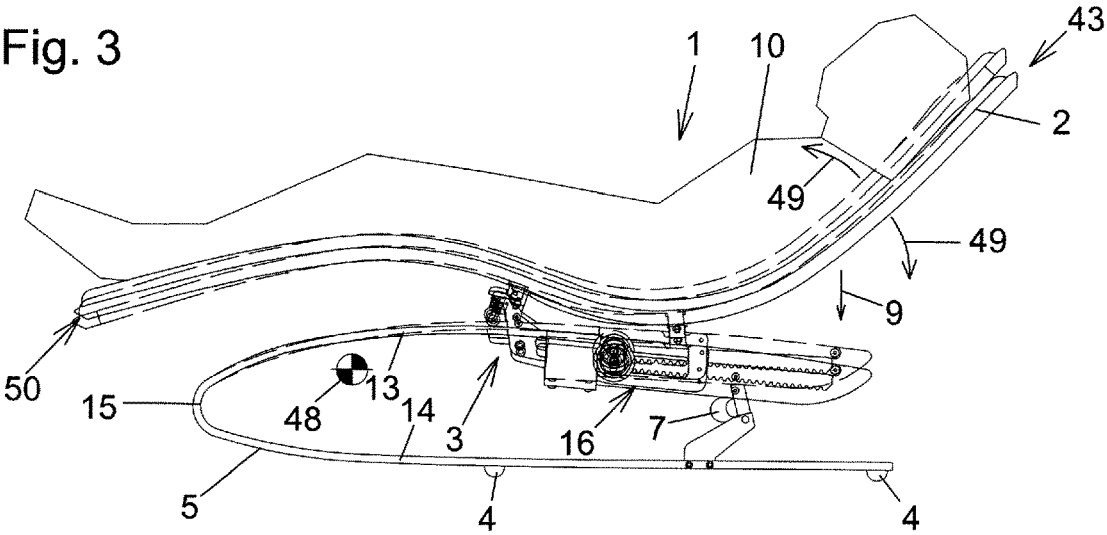
FIG. 3 shows the recliner according to FIG. 2 in an intermediate position to which it has been deflected by means of an additional mass, i.e. in the loaded state.

In the intermediate position shown by solid lines in FIG. 3, the reclining surface 2 together with the person or additional mass 10 lying thereon can execute a free oscillation, or also an oscillation induced by the person's breathing, which oscillation is not influenced by the limiting element 7 or by the stop element 8 if the oscillation amplitude is suitable. In the illustrative embodiment shown, the system composed of the reclining surface 2, the substructure 3 and the person in the form of the additional mass 10 lying thereon, swings about a virtual pivot point 48 underneath the knee region in this illustrative embodiment. The directions of oscillation about this pivot point are indicated by the arrows 49 in FIG. 3. It will be noted that these oscillations have vertical components and also horizontal components. In alternative embodiments of the invention, the reclining surface 2 can also swing exclusively vertically or in other directions of oscillation. However, provision is expediently made that the oscillation directions 49 at least also have a vertical component.

Figure 4:
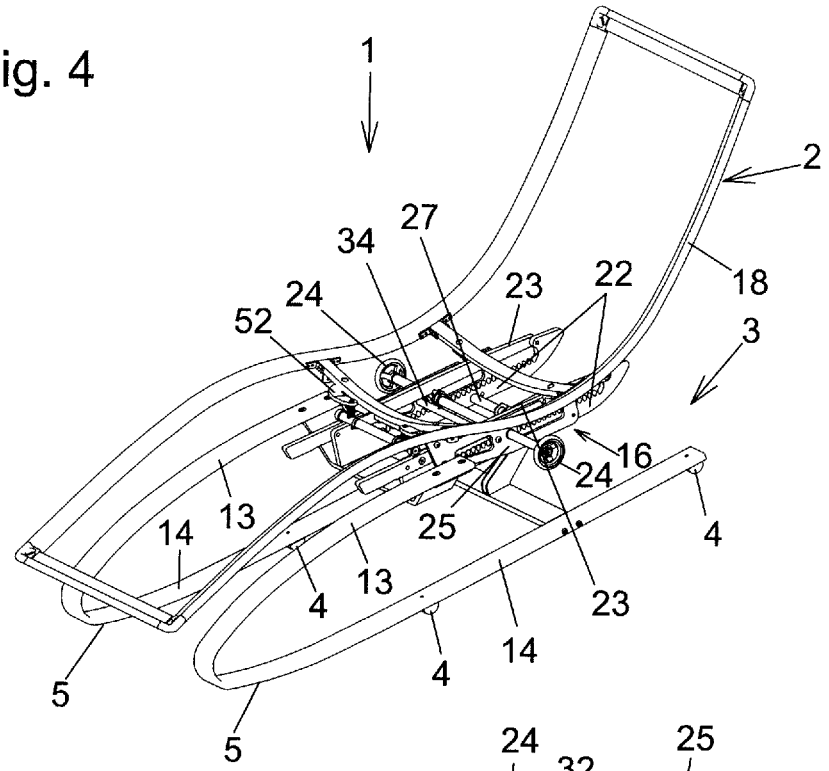
FIGS. 4 to 6 show views illustrating the adjustment device of the illustrative embodiments shown here.
Figure 5:
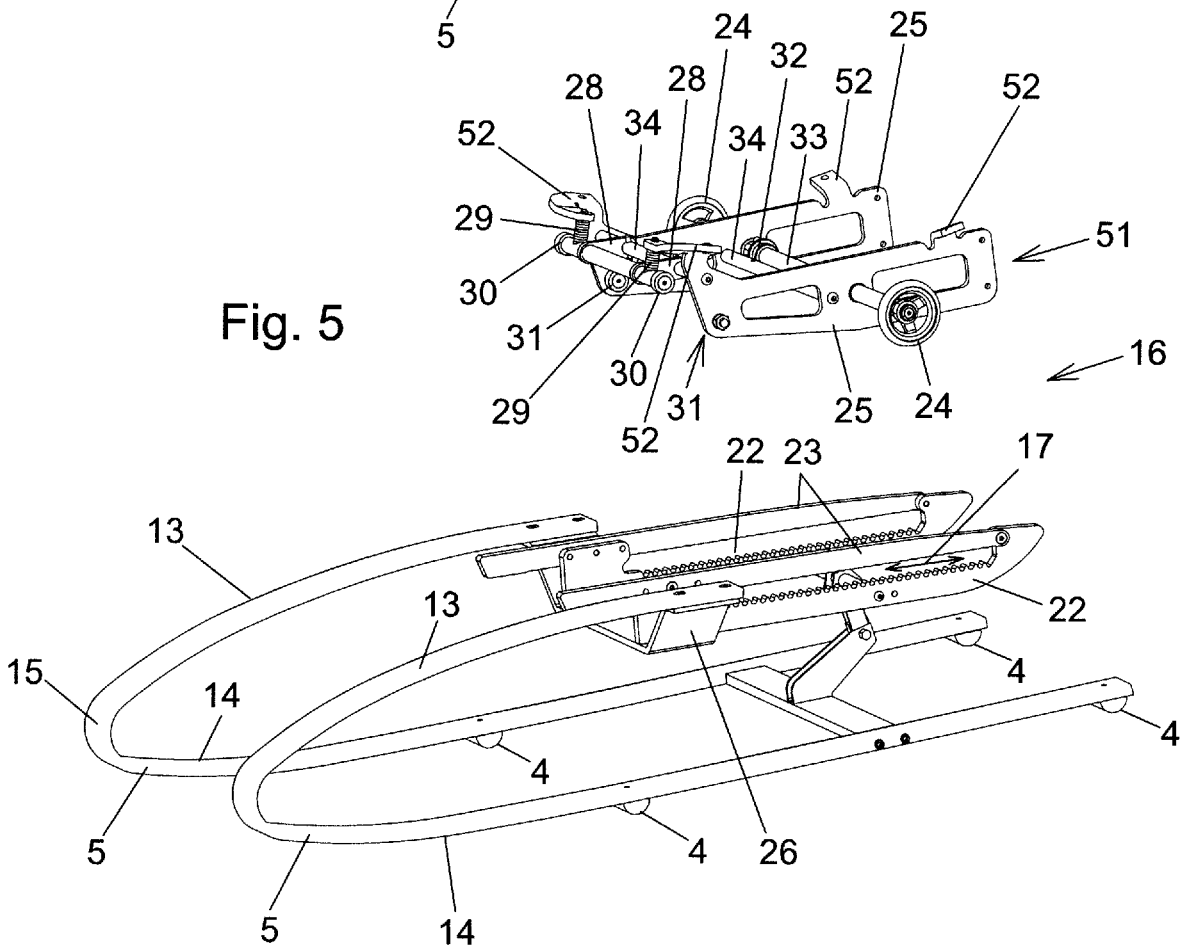
Figure 6:
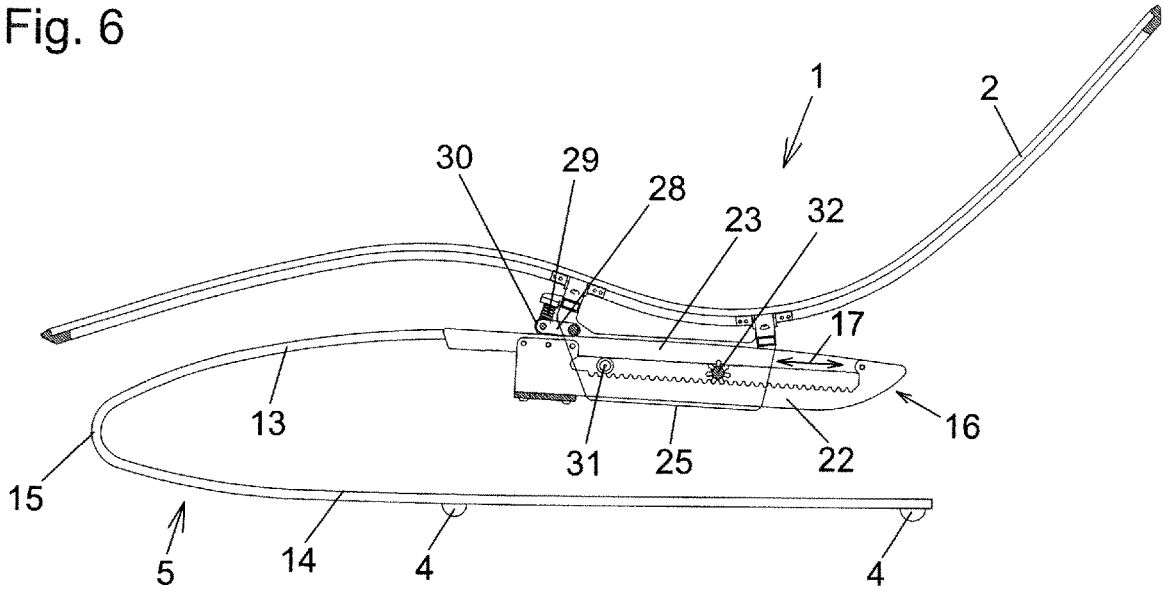

FIG. 4 does not show the cushioning 19 of the reclining surface 2, so that the adjustment device 16 can be better seen. In FIG. 5, the reclining surface 2 is omitted entirely and the adjustment device 16 is shown in an exploded view. In FIG. 6, one of the support walls 25 and the hand wheel 24 have been omitted so as to better show the engagement of the toothed wheel 32 in the toothed rail 22. In the illustrative embodiment shown, the adjustment device is a carriage-like construction, wherein the carriage 51, on the one hand, supports the reclining surface 2 and is fixedly connected thereto via the flaps 52, and, on the other hand, is supported on the guide rails 23. The guide rails 23, together with the toothed rails 22, are fixedly secured on the spring elements 5 or the upper spring legs 13 via the crosspiece 26. The carriage 51 mounted displaceably thereon in the longitudinal directions 17 has two support walls 25, which are rigidly connected to each other by means of the spacer rods 27 and 34. A shaft 33 mounted pivotably in the support walls 25 is guided through the support walls 25, said shaft 33 having, at each of its two opposite ends, a hand wheel 24 mounted fixedly on the shaft 33. In addition, the shaft 33 also carries two toothed wheels 32, which each engage in one of the toothed rails 22. When the hand wheel 24 is turned in the corresponding directions, the carriage 51 can be moved in the longitudinal directions 17 through the engagement of the toothed wheels 32 relative to the toothed rails 22. By way of the upper and lower rollers 30 and 31, the carriage 51 bears on the guide rails 23 fixedly connected to the toothed rails 22. As will be seen in particular from FIG. 6, the lower rollers 31 bear from underneath on the guide rails 23, while the upper rollers 30 are guided above on the guide rails 23. To eliminate play in this arrangement, the upper rollers 30 are secured pivotably on the respective support walls 25 via the lever 28. The compression springs 29 ensure that the upper rollers 30 are pressed from above onto the respective guide rail 23. These compression springs 29 ensure that the carriage 51 is guided free of play on the guide rails 23. The compression springs 29 are so hard that, during swinging of the reclining surface 2 and of the additional mass 10 lying thereon, they have no influence on the oscillations and react virtually as rigid structural bodies.

The adjustment device 16 thus used in the illustrative embodiments shown here can be actuated by one of the hand wheels 24 being suitably turned by hand, in order to adjust the reclining surface 2 in the longitudinal directions 17 relative to the substructure 3. It constitutes a self-locking adjustment mechanism. In the illustrative embodiment, this is achieved by the fact that the toothed wheels 32 have relatively few teeth, preferably fewer than ten teeth, which in addition are preferably configured with rounded corners. In this way, the position that has been set is independently maintained until the hand wheel 24 is actuated again. This self-locking prevents accidental adjustment of the reclining surface 2 in the longitudinal directions 17 during the oscillation. Of course, a position that has been set could also be secured by a separate clamping or locking mechanism or some other mechanism. However, because they are easy to operate, self-locking adjustment devices 16 do of course have corresponding advantages in terms of operating convenience.

Figure 7:
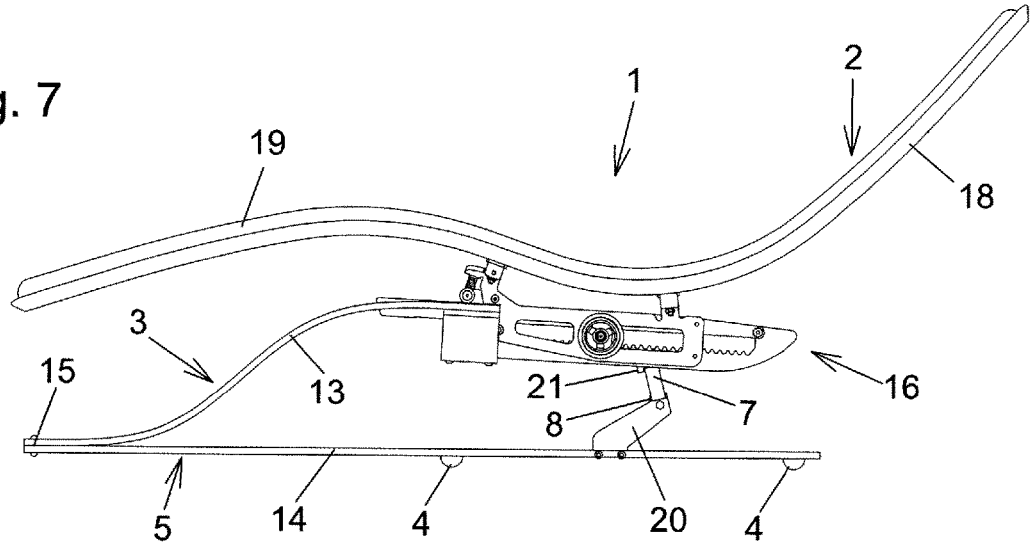
FIGS. 7 and 8 show alternative embodiments of recliners according to the invention.
Figure 8:
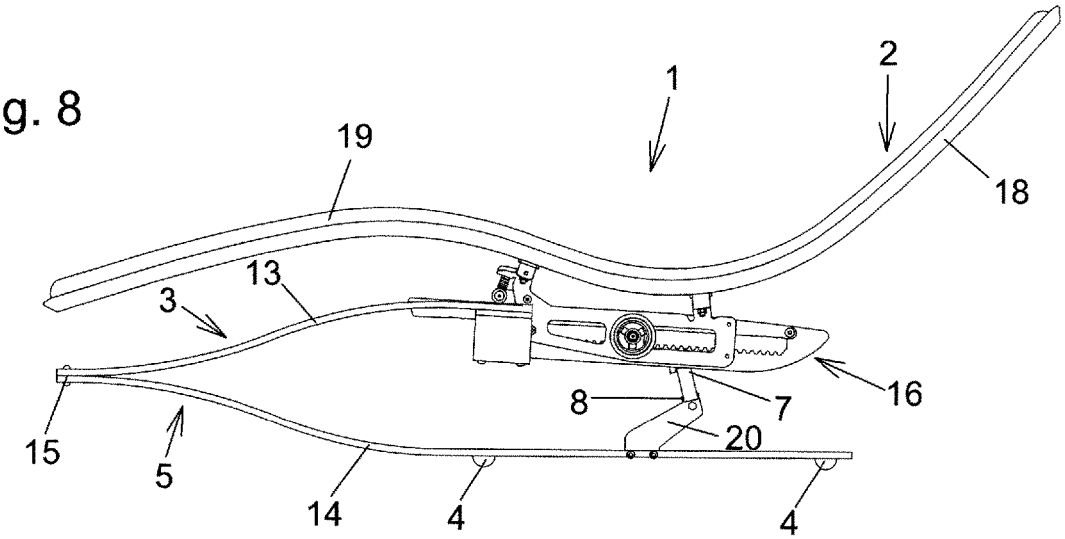

Whereas the spring legs 13 and 14 of the respective spring element 5 in the first illustrative embodiment according to FIGS. 1 to 6 and 9 are connected integrally to each other in the C-shaped connection region 15, alternative embodiments to this are shown in FIGS. 7 and 8. In these variants, the spring legs 13 and 14 are initially manufactured as separate parts and have then been connected to each other in the connection region 15, e.g. by screwing, riveting, bonding and the like. In these illustrative embodiments too, however, the connection region 15 is located under the half of the reclining surface 2 pointing toward the foot end 50, while the spring legs 13 and 14 run at least in part away from each other in the direction toward the head end 43.

The spring legs 13 and 14 or spring elements 5, particularly also in the embodiment variants shown here, can be made of different material. This may include metals and metal alloys, for example steel and the like. However, wood, plastic or other suitable materials could also be used in order to configure the spring elements 5 or springs legs 13 and 14 accordingly.

As has already been explained at the outset, in preferred embodiments of recliners according to the invention, provision is made that the reclining surface in the loaded state has a free oscillation with an oscillation frequency of between 0.1 and 1 Hertz. Specifically, it is preferable if the reclining surface 2, with an additional mass 10 of 85 kg lying on the reclining surface 2, and after a single deflection from a rest position in the direction toward the stand 4, has an oscillation frequency of between 0.1 and 1 Hertz in a free oscillation following the deflection. In addition, provision is preferably made that the reclining surface 2 in the loaded state can execute an oscillation with relatively little damping. In this sense, provision is preferably made that the reclining surface 2, with an additional mass 10 of 85 kg lying on the reclining surface 2, and after a single deflection from a rest position in the direction toward the stand 4, has an amplitude retention of greater than or equal to 20% in a free oscillation following the deflection, wherein the amplitude retention is calculated from the ratio of an amplitude 11 of the sixth oscillation period 46 after deflection to an amplitude 12 of the second oscillation period 47 after deflection.

These properties can be established on a corresponding recliner, for example following the test procedure set out below.

The additional mass of 85 kg can be realized, in the sense of a standardized measurement, by a replacement mass body, as shown in FIG. 9. This replacement mass body has two circular cylinders 39, each with a diameter of 150 mm and a width of 290 mm, and each having a mass of 40 kg. These two circular cylinders 39 are arranged with their cylinder longitudinal axis parallel to each other and are rigidly connected to each other, with a spacing of 900 mm, by a connecting rod 40. The straight connecting rod 40 weighs 5 kg. Both the connecting rod 40 and the circular cylinders 39 have a homogeneous density distribution. The additional mass 10, thus in the form of a replacement mass body, is thus placed onto the reclining surface 2 of the otherwise unloaded recliner 1, such that the center of gravity 37 of this additional mass 10 comes to lie on a vertical 38 through the area centroid 36 of the bearing surface 35 of the reclining surface 2. The vertical 38 runs in a plane of symmetry 42, in which the central longitudinal axis 41 of the reclining surface 2 also lies. The replacement mass body in the form of the additional mass 10 is aligned with its connecting rod 40 on the central longitudinal axis 41, as is shown in FIG. 9. The area centroid 36 of the bearing surface 35 of the reclining surface 2 is the geometric center point of the bearing surface 35 of the reclining surface 2 defined for the person or the additional mass 10 to lie on. For a surface K with an area content A, the area centroid is defined by $$x_s = \frac{1}{A}\int_K x\,dA,$$

$$y_s = \frac{1}{A}\int_K y\,dA,$$

$$z_s = \frac{1}{A}\int_K z\,dA$$

with $$A = \int_K dA$$

For the test described below, the additional mass 10 thus positioned is fixed on the reclining surface 2 insofar as this is necessary for maintaining the position relative to the reclining surface 2.

When the additional mass 10 is placed onto the reclining surface 2, the latter, as shown schematically in FIG. 3, is deflected from the starting position of the unloaded state to the intermediate position in the loaded state. For the excitation of the free oscillation, the reclining surface 2 together with the additional mass 10 lying on it undergoes a single deflection from the rest position defined by the intermediate position, e.g. by a single pressing-down of the head end 43 of the reclining surface 2 in the direction 9 toward the stands 4. As soon as the head end 43 is then let go, a free, damped oscillation takes place, which is recorded and evaluated in order to determine the parameters mentioned below. It is no longer important what force is applied in the single deflection from the rest position, and how far the head end 43 is deflected for the excitation of the oscillation, as long as an oscillation signal that can be easily measured is obtained. The excitation of this natural oscillation should be so powerful that the amplitude profile can be clearly followed and recorded over at least six oscillations. However, the excitation should also not be so great that the limiting element 7 and the stop element 8 interfere with the free oscillation.

To record the free oscillation, various measuring systems can be used and various measuring points on the reclining surface 2 can be observed. To obtain the best possible signal, a point of the reclining surface 2 should be chosen at which the oscillation amplitude is as great as possible. In the illustrative embodiment shown, this is the measuring point 44 at the head end 43 of the reclining surface 2.

To record the amplitude profile 45 of the free oscillation as a function of time, various measuring systems known per se can be used. It is important that these measuring systems do not significantly disturb the oscillation behavior of the reclining surface 2 and the additional mass 10. For example, optical recording as a function of time is conceivable, in which a film or the like is used to record the pivoting process of the measuring point 44 from the side as a function of time. Known path sensors or acceleration sensors known per se could also be secured to the measuring point 44 to record the path or the acceleration of the measuring point during the oscillation as a function of time.

Figure 10:
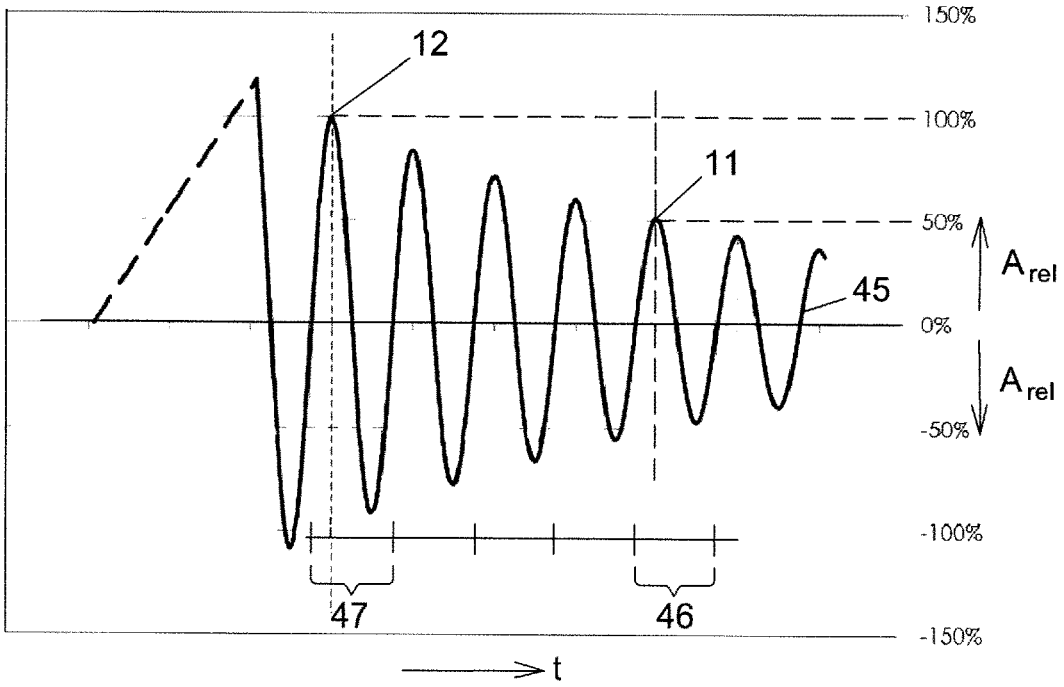

FIG. 10 shows an example of a measurement result recorded in this way. It shows the amplitude profile 45 of a relative amplitude $A^{rel}$ against time t. From this result, the oscillation frequency can be calculated as an inverse of the duration of one of the oscillation periods 46 or 47. Should the oscillation frequency between the second oscillation period 47 and the sixth oscillation period 46 change, an arithmetic mean should be calculated over these two oscillation periods 46 and 47. The first amplitude period, temporally preceding the second oscillation period 47, is not used, since it may still be disturbed by the excitation of the oscillation. To determine the start and end of a respective oscillation period 46 and 47, it is possible to use both the zero crossing of the signal and also the spacing between two adjacent maxima. In preferred embodiments of recliners 1 according to the invention, this evaluation at any rate gives an oscillation frequency or natural frequency of between 0.1 Hertz and 1 Hertz in this evaluation.

To calculate the amplitude retention, the ratio of the amplitude 11 of the sixth oscillation period 46 after deflection to the amplitude 12 of the second oscillation period 47 after deflection is calculated. This amplitude retention should be less than or equal to 20%. The maximum amplitude in the respective oscillation period is preferably used in the determination of the amplitude. In the illustrative embodiment shown, the relative amplitude $A^{rel}$ is standardized such that the maximum amplitude 12 of the second oscillation period 47 corresponds to 100%. The maximum amplitude 11 of the sixth oscillation period corresponds to 50%, such that there is an amplitude retention of 50% in the example shown here.

If the recliners 1 to be tested are those with an adjustment device 16, then the stated oscillation frequencies and amplitude retentions should be obtained in at least one possible setting of the adjustment device 16.

KEY TO THE REFERENCE NUMBERS

1 recliner
2 reclining surface

3 substructure
4 stand
5 spring element
6 direction
7 limiting element
8 stop element
9 direction
10 additional mass
11 amplitude
12 amplitude
13 spring leg
14 spring leg
15 connection region
16 adjustment device
17 longitudinal direction
18 reclining frame
19 cushioning
20 stop bracket
21 counter-stop
22 toothed rail
23 guide rail
24 hand wheel
25 support wall
26 crosspiece
27 spacer rod
28 lever
29 compression spring
30 upper roller
31 lower roller
32 toothed wheel
33 shaft
34 spacer rod
35 bearing surface
36 area centroid
37 center of gravity
38 vertical
39 circular cylinder
40 connecting rod
41 central longitudinal axis
42 plane of symmetry
43 head end
44 measuring point
45 amplitude profile
46 oscillation period
47 oscillation period
48 pivot point
49 oscillation direction
50 foot end
51 carriage
52 flap

The invention claimed is:

1. A recliner, comprising a reclining surface and a substructure that is adapted to be set on a base and supports the reclining surface, the substructure having a stand and at least one spring element arranged between the stand and the reclining surface, and the reclining surface being mounted on the spring element, the spring element elastically pretensions the reclining surface in a direction away from the stand, and the reclining surface, in an unloaded state, is kept elastically pretensioned by a limiting element of the recliner, and the recliner is configured such that with an additional mass of 85 kg being located on the reclining surface, after a single deflection from a rest position in the direction toward the stand, the reclining surface has an oscillation frequency of between 0.1 and 1 Hertz in a free oscillation following the single deflection.

2. The recliner as claimed in claim 1, wherein the limiting element limits a deflection of the reclining surface, in the unloaded state, in the direction away from the stand.

3. The recliner as claimed in claim 1, further comprising a stop element that limits a deflection of the reclining surface, in a loaded state, in a direction toward the stand.

4. The recliner as claimed in claim 1, wherein the reclining surface, in the unloaded state, is arranged in a starting position, and, in a loaded state with the additional mass lying on the reclining surface, is arranged in an intermediate position deflected relative to the starting position.

5. The recliner as claimed in claim 4, wherein the reclining surface in the loaded state is adapted to swing freely about the deflected intermediate position.

6. The recliner as claimed in claim 1, wherein the at least one spring element has two spring legs which are connected to each other in a connection region.

7. The recliner as claimed in claim 6, wherein at least in the unloaded state, the two spring legs arranged running at least in part away from each other starting from the connection region.

8. The recliner as claimed in claim 6, wherein the connection region is C-shaped.

9. The recliner as claimed in claim 1, wherein the at least one spring element has two spring legs which are integrally connected to each other in a connection region.

10. The recliner as claimed in claim 1, further comprising an adjustment device for adjusting the reclining surface relative to the spring element in mutually opposite longitudinal directions of the reclining surface.

11. A method of using a recliner as claimed in claim 1, the method comprising, upon a person lying down on the reclining surface, the reclining surface deflecting from a starting position, that the reclining surface adopts in the unloaded state, to an intermediate position deflected relative to the starting position, and the reclining surface with the person lying thereon moving, starting from the intermediate position, in an oscillation that is adapted to be excited only by a person's breathing.

12. A recliner, comprising a reclining surface and a substructure that is adapted to be set on a base and supports the reclining surface, the substructure having at least one stand and at least one spring element arranged between the stand and the reclining surface, and the reclining surface being mounted on the spring element, the spring element elastically pretensions the reclining surface in a direction away from the stand, and the reclining surface, in an unloaded state, is kept elastically pretensioned by a limiting element of the recliner, the recliner is configured such that with an additional mass of 85 kg located on the reclining surface, and after a single deflection from a rest position in the direction toward the stand, the reclining surface has an amplitude retention of greater than or equal to 20% in a free oscillation following the single deflection, wherein the amplitude retention is calculated from a ratio of an amplitude of a sixth oscillation period after deflection to an amplitude of a second oscillation period after deflection.

* * * * *